United States Patent [19]

Davies et al.

[11] Patent Number: 4,968,859

[45] Date of Patent: Nov. 6, 1990

[54] CIRCUIT BREAKER WITH LOW VOLTAGE CONTACT STRUCTURE

[75] Inventors: Norman Davies, Penn Township, Westmoreland County; Walter V. Bratkowski, McKeesport; Daun Bhasavanich, Monroeville, all of Pa.

[73] Assignee: Westinghouse Electric Corp., Pittsburgh, Pa.

[21] Appl. No.: 260,766

[22] Filed: Oct. 21, 1988

[51] Int. Cl.[5] ..... H01H 33/12

[52] U.S. Cl. ..... 200/146 R

[58] Field of Search ..... 200/146 R; 335/195, 335/201

[56] References Cited

U.S. PATENT DOCUMENTS 2,514,839 7/1950 Caswell ..... 200/146 R
2,545,341 3/1951 Caswell ..... 335/201
2,959,654 11/1960 Caswell et al. ..... 200/146 R
3,238,339 3/1966 Fehling ..... 200/146 R

*Primary Examiner*—Robert S. Macon
*Attorney, Agent, or Firm*—M. J. Moran

[57] ABSTRACT

A circuit breaker characterized by first and second main contacts and first and second arcing contacts. The first main and arcing contacts are mounted on a first contact carrying arm. The second arcing contacts are mounted on a second contact carrying arm. The second main contacts are mounted on a third contact arm. The first contact carrying arm is mounted on a first pivot and the second and third contact carrying arms are mounted on a second pivot. A spring for biasing the second main contact against the first main contact and in the closed position. A second spring for biasing the second arcing contact against the first arcing contact until after the first and second main contact separate.

5 Claims, 5 Drawing Sheets

CIRCUIT BREAKER WITH LOW VOLTAGE CONTACT STRUCTURE

CROSS-REFERENCE TO RELATED APPLICATIONS

Reference is hereby made to the following co-pending application dealing with related subject matter and assigned to the assignee of the present invention:

"Circuit Breaker Operating Structure" by Walter V. Bratkowski, Daun Bhasavanich, and Norman Davies, U.S. Ser. No. 260,767, filed Oct. 21, 1988.

BACKGROUND OF THE INVENTION

1. Field of the Invention

The present invention relates to low voltage circuit breakers of a power class and, more particularly, it pertains to the use of arcing contacts with main contacts for greater protection of the circuit breaker contacts.

2. Description of the Prior Art

Circuit breakers provide protection for current distribution systems. Protection for an electrical circuit or system is provided to avoid electrical over-current conditions, such as high and low level, short circuit, or fault current conditions.

When contacts of the circuit breaker are opened, an arc is usually created which is accompanied by the generation of ionized gases. This is particularly true for circuit breakers with high interruption ratings, whereby the voltage dielectric withstand deteriorates following arcing. For that reason, there is a need for preventing electrical breakdowns of the circuit breaker contacts as well as parts adjacent thereto.

Associated with the foregoing is the necessity of extinguishing the arc as expediently as possible. Many circuit breakers of prior art construction fail simply because of the inability for fast arc extinction and rapid clearance of arc product; ionized gas.

SUMMARY OF THE INVENTION

In accordance with this invention, the circuit breaker is provided which comprises a circuit breaker structure including first and second main contacts and first and second arcing contacts, which contacts are movable between opened and closed positions, an operating mechanism for releasably opening the contacts, a first contact arm carrying the first contacts and pivotally mounted at a first pivot, a second contact arm carrying the second arcing contact and pivotally mounted at a second pivot, third contact arm carrying the second main contact and pivotally mounted at the second pivot, the second main contact comprising a pair of contacts and the third contact arm comprising a pair of arms with a second contact on each arm, a trip structure for latching the releasable mechanism in the closed contact position and for releasing the mechanism, bias means for yieldingly retaining the main contacts closed below a predetermined over-current condition, and the bias means operating during initial opening motion of the second contact arms and for successively closing the arcing contacts, opening the main contacts, and then opening the arcing contacts more rapidly.

The advantage of the device of this invention is that the contacts open and propel the resulting arc from the main contacts more rapidly.

DESCRIPTION OF THE PREFERRED EMBODIMENT

Figure 1:
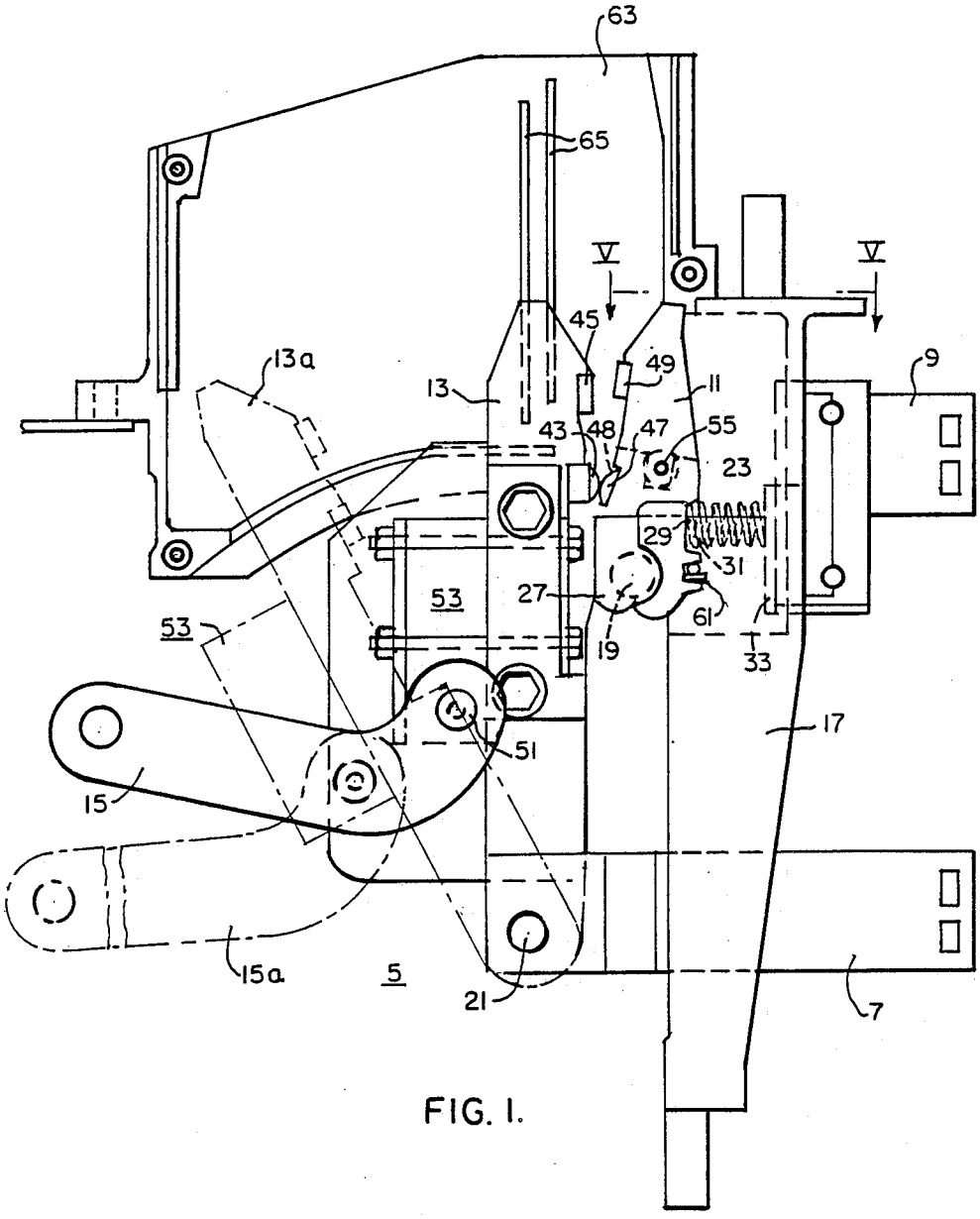
FIG. 1 is an elevational view showing main contacts in a closed (solid line) position and in an open (broken line) position.

A circuit breaker is generally indicated at 5 in FIG. 1 and it comprises line and load terminals 7, 9, a contact arm 11, a movable contact arm 13, and an operating mechanism including a mechanism link 15. For a more complete description of an operating mechanism for the type of circuit breaker disclosed herein, reference is made to U.S. Pat. No. 3,849,619 issued Nov. 19, 1974, of which the inventor is Nagar J. Patel.

An insulating support structure 17 is provided for supporting the terminals 7 and 9 and for supporting a pivot pin 19 for the contact arm 11. The movable contact arm 13 is supported on a second pivot pin 21 at the left end portion of the terminal 7.

Figure 5:
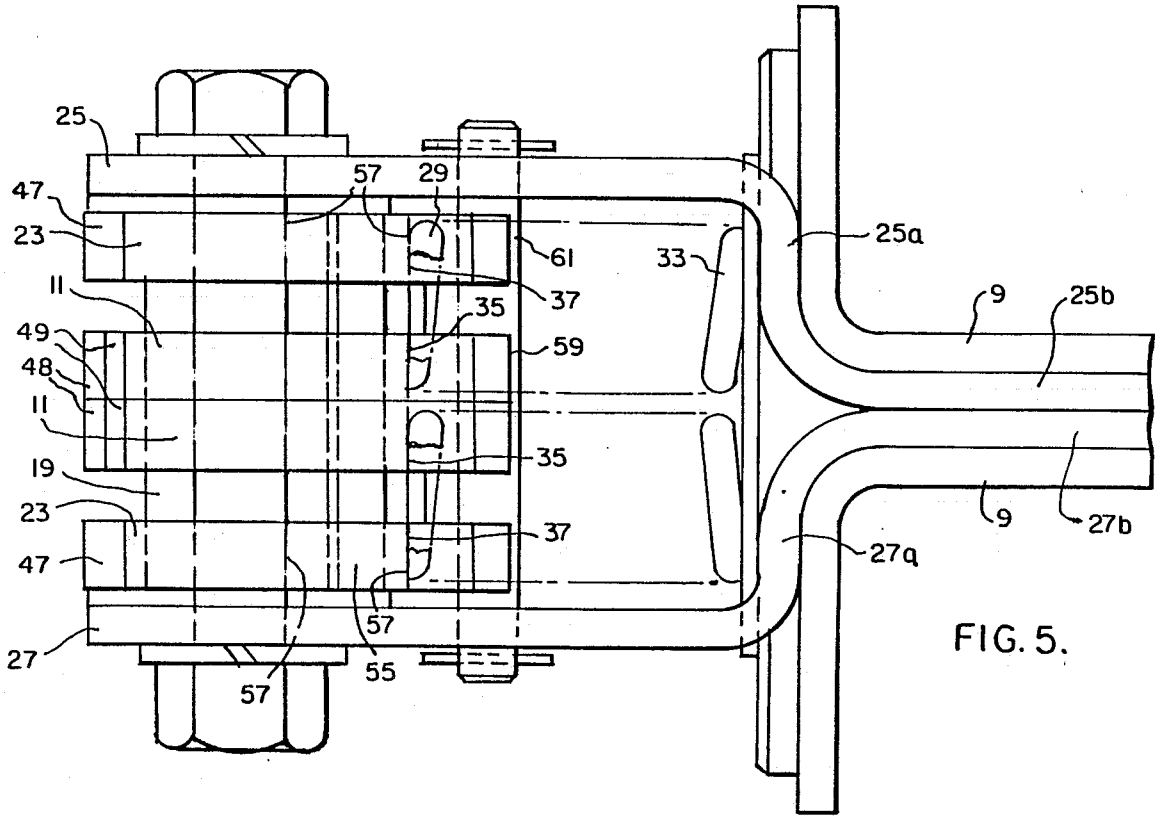
FIG. 5 is a horizontal, sectional view taken on the line V—V of FIG. 1.

A contact arm 23 is pivotally mounted on the pivot pin 19 and is comprised of a pair of arms 23 (FIG. 5) which are disposed on opposite sides of the contact arm 11 on the pivot pin 19. As shown in FIG. 5, the assembly of the arms 11, 23, and pivot pin 19 are mounted in a pair of spaced brackets 25, 27 which combine to form a yoke having bight portions *25a*, *27a* and longitudinally extending portions *25b*, *27b* which are in good electrical, surface-to-surface, contact with the load terminal 9.

In accordance with this invention, bias means, such as a pair of coil springs 29, 31 (FIGS. 1 and 5) are disposed between the insulating support structure 17 and the contact arms 11, 23. More particularly, the springs 29, 31 extend between an insulating pad 33 on one side and edges 35, 37 of the arms 11, 23 which are parts of notches 39, 41, respectively, of the arms 11, 23. The springs 29, 31 urge the arms 11, 23 in a counterclockwise direction around the pivot pin 19.

As shown in FIG. 1, the movable contact arm 13 supports a main contact 43 and an arcing contact 45. Correspondingly, the arms 23 support similar main contacts 47. The arms 11 supports main contacts 48 and an arcing contact 49. More particularly, as shown in FIG. 5, the pair of contact arms 23 includes similar main contacts 47 which simultaneously engage the main contact 43 on the contact arm 13 when the circuit is closed. A circuit through the circuit breaker 5 extends from the line terminal 7, through the pivot pin 21, contact arm 13, the contacts 43, 47, the contact arms 23, the pivot pin 19, the brackets 25, 27, and to the load terminal 9.

When the circuit breaker 5 senses an overcurrent condition, such as a short circuit, the movable contact arm 13 is rotated counterclockwise to the open position 13*a* by the link 15 which is pivotally connected by pivot pin 51 to a mounting block 53 on the arm. It is desirable to avoid any arcing between the main contacts 43, 47 and to transfer any arcing to the arcing contacts 45, 49 which (FIG. 1) are not in contact during the normal operation of the circuit breaker when the main contacts 43, 47 are closed.

Figure 2:
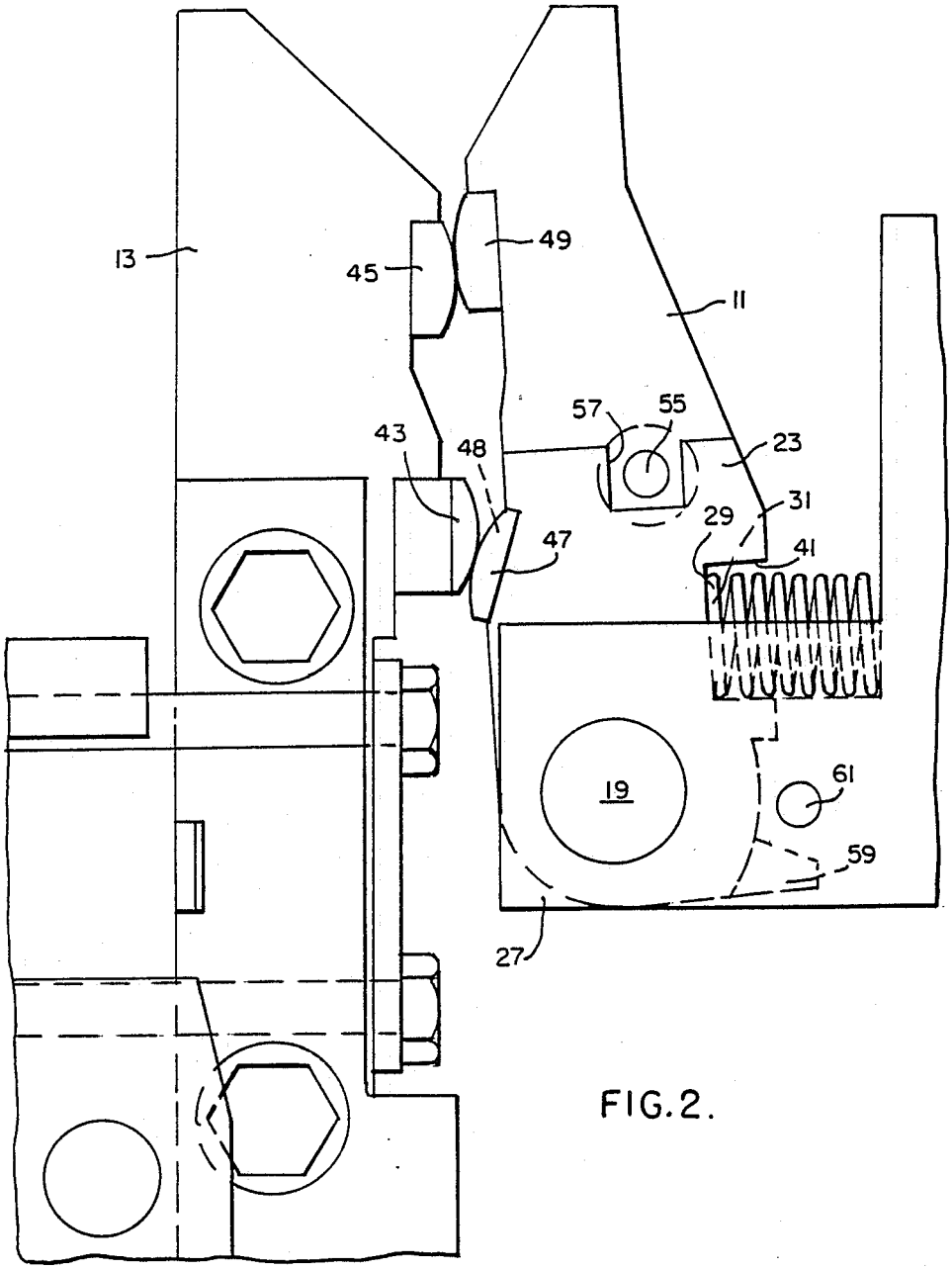
FIG. 2 is an elevational view showing the closed position of the main and arcing contacts during the initial movement of the contact arm to the open position after being tripped.
Figure 3:
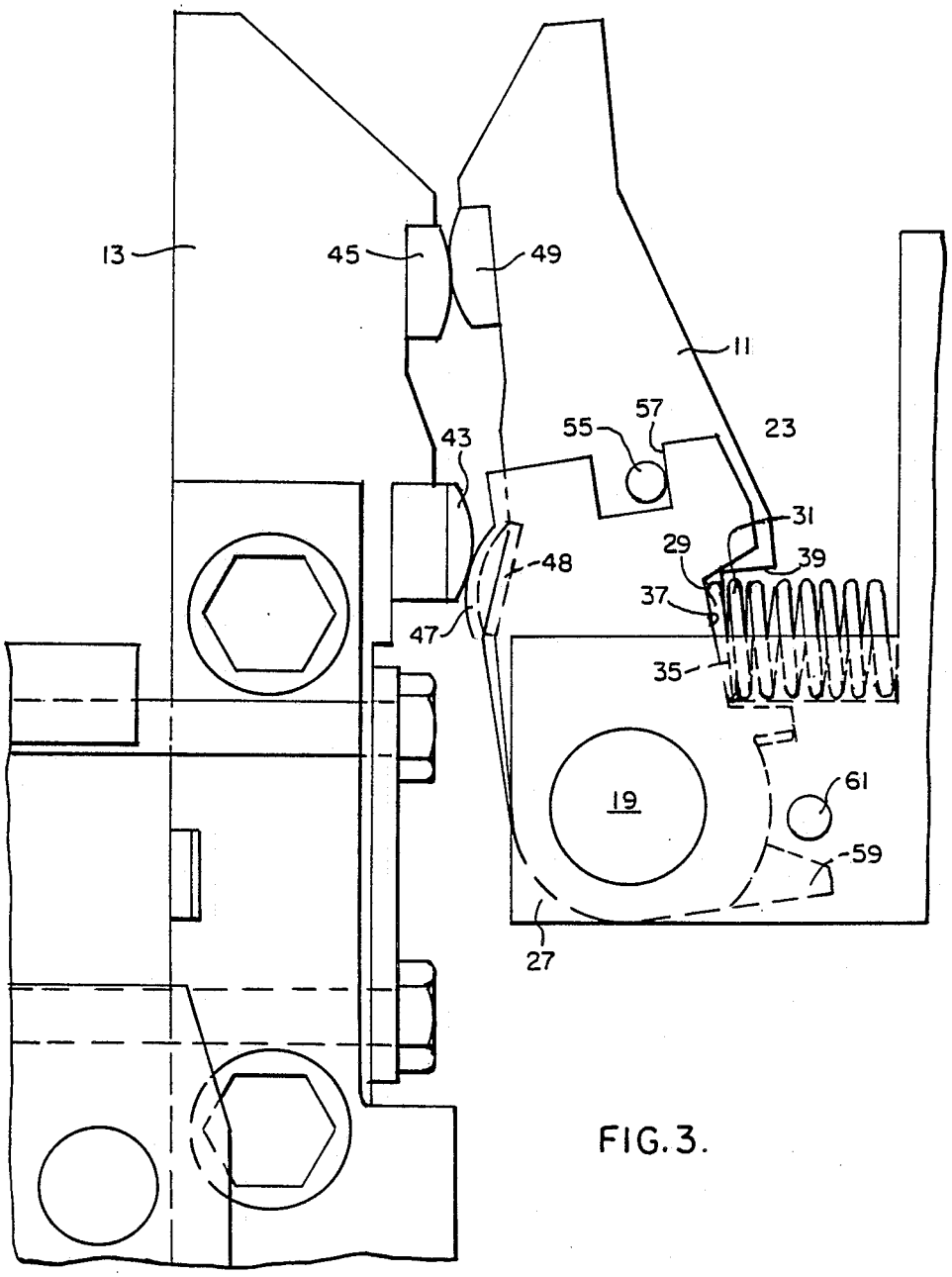
FIG. 3 is an elevational view showing the contact arm in a subsequent position following that of FIG. 2 during movement of the contact arm to the fully opened position.
Figure 4:
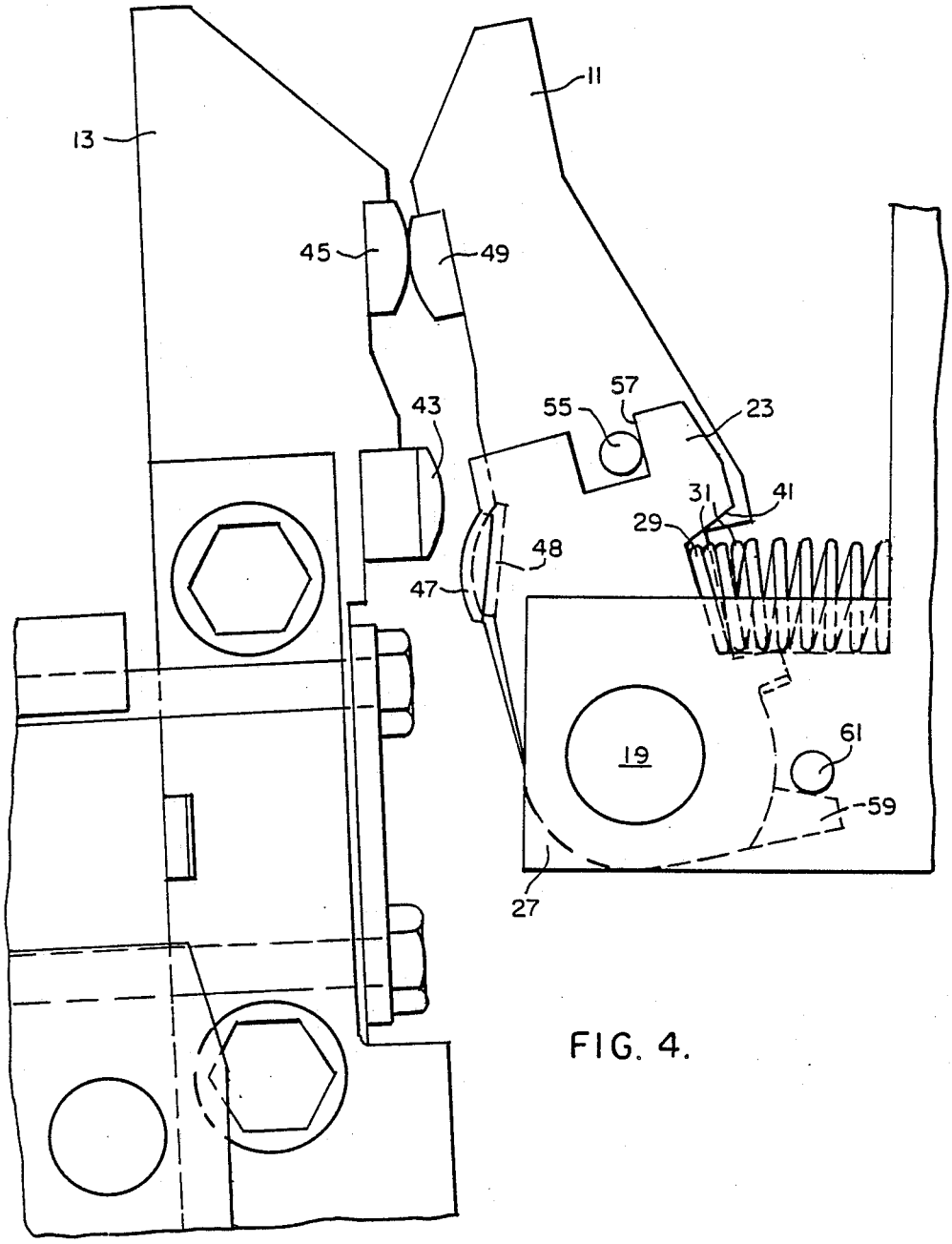
FIG. 4 is an elevational view showing the contact arm in a position subsequent to that of FIG. 3 in which the main contacts are now open and the arcing contacts are still closed.

During the opening of the circuit breaker from the closed position of the contact arm 13 to the open position 13*a*, interaction between the main and arcing contacts occurs in three stages as shown in FIGS. 2, 3, and 4. In FIG. 2, as the contact arm 13 initially moves counterclockwise, the pressure of the coil springs 29, 31 urge the contact arms 11, 23 counterclockwise to maintain the main contacts 43, 47 in engagement with each other while moving the arcing contact 49 against the arcing contact 45. In that position, a pin 55 mounted in the contact arm 11 (FIG. 5) is disposed substantially, centrally within a notch 57 in the contact arms 23 on opposite sides of the arm 11.

As shown in FIG. 3, continued counterclockwise movement of the contact arms 13 by the link 15, the arms 11, 23 continue movement in response to the pressure of the springs 29, 31, maintains the main contacts 43, 47 and arcing contacts 45, 49 in engagement with each other. But the main contacts 48 on arms 11 separate from contacts 43. During this stage, the pin 55 moves into contact with one side of the notch 57.

Continued movement of the contact arms 13, 11, 23 into the third stage of the opening procedure opens the main contacts 43, 47, while maintaining engagement between the arcing contacts 45, 49 (FIG. 4). The contact arms 23 are limited from further counterclockwise rotation by engagement of the pin 55 with the side of the notch 57. However, the coil springs 29, 31 continue moving the contact arm 11 counterclockwise until a projection 59 on the contact arm 11 strikes a limit pin 61 which is mounted on and between the brackets 25, 27 (FIG. 5).

Continued rotation of the contact arm 13 counterclockwise causes separation of the arcing contacts 45, 49 with the contact arm 13 ultimately moving to the fully opened position 13*a* (FIG. 1). Any electric arc occurring between the arcing contacts 45, 49 is dissipated in an arc chute 63 having a plurality of spaced arc-extinguishing plates 65 in a conventional manner.

Manifestly, when the operating mechanism of the circuit breaker 5 functions to close the contacts via the link 15, the contact arm 13 is rotated clockwise to the solid line position (FIG. 1) with the interplay between the contact arms and contacts occurring in the reverse movement through FIGS. 4, 3, 2, 1. Thus, the main contacts 43, 47 are closed first in good electrical contact in response to the pressure of the coil springs 29, 31.

In conclusion, the particular structure including one movable contact arm supporting a main contact and a arcing contact together with a pair of other contact arms separately supporting a main contact and an arcing contact, respectively, provides a more highly efficient circuit breaker, because an electric arc ultimately develops between the arcing contacts and then is blown by JxB forces uninhibitedly moves into the arc chute, thereby preventing destruction of the main contacts.

What is claimed is:

1. A circuit breaker comprising:

a circuit breaker structure including first and second main contacts and first and second arcing contacts;

the first and second contacts being movable between open and closed positions;

an operating releasable mechanism for releasably opening the contacts;

a first contact arm carrying the first contacts and pivotally mounted at a first pivot;

a second contact arm carrying the second arcing contact and pivotally mounted at a second pivot;

a third contact arm carrying the second main contact and pivotally mounted at the second pivot;

a trip structure for latching the releasable mechanism in the closed contact position and for releasing the mechanism;

bias means for yieldingly retaining the main contacts closed below a predetermined overcurrent rating, the bias means operating during opening motion of the second contact arm for successively closing the arcing contacts, opening the main contacts, and then opening the arcing contacts.

2. The contact breaker of claim 1 in which the third contact arm is adjacent to the second contact arm.

3. The contact breaker of claim 2 in which the third contact arm includes a pair of main contact arms.

4. The circuit breaker of claim 3 in which the second main contact includes a pair of main contacts, one on each third contact arm.

5. The circuit breaker of claim 4 in which the bias means comprises a spring for retaining the first and second main contacts together and for retaining the arcing contacts together until after the main contacts open.

* * * * *